US006194831B1

(12) United States Patent
Park et al.

(10) Patent No.: US 6,194,831 B1
(45) Date of Patent: Feb. 27, 2001

(54) GAS DISCHARGE DISPLAY

(75) Inventors: Hun Gun Park; Seok Hyun Lee, both of Inchon-kwangyoksi; Won Tae Kim, Kyungsangbuk-do; Hong Ju Ha, Kyungsangbuk-do; Jae Hwa Ryu, Kyungsangbuk-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/151,732

(22) Filed: Sep. 11, 1998

(30) Foreign Application Priority Data

Sep. 12, 1997 (KR) ..... 97-47134
Jul. 2, 1998 (KR) ..... 98-26662

(51) Int. Cl.[7] ..... H01J 17/49
(52) U.S. Cl. ..... 313/582; 313/581
(58) Field of Search ..... 313/483, 484, 313/485, 493, 581, 582

(56) References Cited

U.S. PATENT DOCUMENTS

| | | | | |
|---|---|---|---|---|
| 3,925,697 | | 12/1975 | Fein et al. | 313/223 |
| 4,013,912 | | 3/1977 | Hinson | 313/226 |
| 4,027,191 | * | 5/1977 | Schaufele et al. | 313/493 |
| 4,249,105 | * | 2/1981 | Kamegaya et al. | 313/484 |
| 4,376,256 | * | 3/1983 | Hanlet | 313/485 |
| 5,438,343 | * | 8/1995 | Khan et al. | 445/44 |

FOREIGN PATENT DOCUMENTS

| | | |
|---|---|---|
| 63205031 | 8/1988 | (JP) . |
| 06342631 | 12/1994 | (JP) . |

* cited by examiner

*Primary Examiner*—Nimeshkumar D. Patel
*Assistant Examiner*—Todd Reed Hopper
(74) *Attorney, Agent, or Firm*—Fleshner & Kim, LLP

(57) ABSTRACT

The present case relates to a gas discharge display, represented with a plasma display panel(PDP), for displaying an image by displaying gradation using a discharge characteristic of a particular gas. Of a background art gas discharge display for displaying an image by means of a gas discharge having transparent front, and back substrates supported by barrier ribs of a fixed length from inside thereof, electrodes, dielectric, and protective film provided inside of the front, and back substrates, and Penning gas of two gases (Ne+Xe, He+Xe, and etc.) or Penning gas of three gases (Ne+Xe+Ar, He+Xe+Ar, Ne+Xe+He) filled in spaces of the two protective films as a discharge gas, a Penning gas of four gases (Ne+He+Xe+Ar) is used in the gas discharge display for improving a luminance. Accordingly, by using the Penning gas of four gases, this case can satisfy a longer life time, a lower discharge starting voltage, a higher luminance, and an improved color purity in comparison to a CRT display on the same time, thereby allowing realization of a next generation wall mounting large sized display.

12 Claims, 13 Drawing Sheets

GAS DISCHARGE DISPLAY

BACKGROUND OF THE INVENTION

1. Field of the Invention

The present invention relates to a gas discharge display, and more particularly, to a gas discharge display for use in a PDP(Plasma Display Panel), in which a discharge region is filled with 4 kind of gases mixed at a particular ratio, for improving a reliability of a product.

2. Discussion of the Related Art

In general, there are a DC type, an AC type, and a hybrid type, a combination of the DC type and the AC type, in the gas discharge display in view of electrode structure. The DC type and the AC type differ in that whether the electrode is exposed directly to discharge plasma or indirectly through a dielectric layer. In the case of the DC type PDP, the electrode is exposed directly to the discharge plasma, and, in the case of the AC type PDP, the electrode joins with the discharge plasma indirectly through the dielectric layer. This difference leads to show a difference in discharge. In the case of the AC type PDP, charged particles formed from discharges are accumulated on the dielectric layer. That is, electrons are accumulated on the dielectric layer over an electrode having a positive potential charged thereto, and ions are accumulated on the dielectric layer over an electrode having a negative potential charged thereto. A potential formed by this phenomenon is called as a wall potential, which has a polarity opposite to an external potential, to lower a potential applied to a gas in a cell once the wall potential is started to form. Accordingly, an adequate wall potential is formed, the potential applied to the gas is lowered below a level at which a sustaining of the discharge is possible no more, the discharge is canceled. However, if the polarity of the potential applied to the external electrode is changed after the wall potential is formed, the potential applied externally will be added on top of the wall potential, allowing the AC type PDP operative according to a memory function in which a discharge can be made even if a low external potential is applied. Thus, the AC type PDP has the memory function due to the wall potential accumulated on the dielectric layer. That is, a cell having a discharge made previously to form a wall potential on the dielectric in the cell can make a discharge at a voltage lower than a cell without the wall potential. This memory function is very useful characteristic for operating a large sized PDP, a gas discharge display employing line driving system. Different from the AC type PDP, since the DC type PDP has no function of the wall potential formation on the dielectric, it has no intrinsic memory function. That is, as the electrode is directly exposed to a discharge region, charged particles from the discharge flow to external circuits through electrodes of opposite polarities, without any accumulation of the charged particles on electrode surfaces. However, in the case of the DC type PDP, a pulse memory function in which a charged particle supply effect is employed is used. The pulse memory function employs a principle that a discharge can be made at a voltage lower than a case when there are no charged particles, and quasi neutral particles if a discharge pulse is applied before the charged, and quasi neutral particles formed from a previous discharge are attenuated. This memory function is an essential feature for allowing operation of a large sized panel in the line driving system without loss of luminance and is also required in view of an electrode structure.

FIGS. 1 and 2 illustrate sections showing basic electrode structures of the DC type PDP and the AC type PDP, respectively.

Referring to FIG. 1, the basic electrode structure of the DC type PDP is provided with an anode 3 and cathode 4 on a front substrate 1 and a back substrate 2 respectively, barrier ribs 5, and a fluorescent material layer 6. The anode 3 and the cathode 4 forms a current path for forming a discharge. The barrier rib 5 fixes a distance between electrodes for forming the discharge, and prevent a crosstalk caused by a discharge in an adjacent cell. In the DC type PDP, nickel is mostly used as an electrode material, which has a high secondary electron emission coefficient for providing a low discharge voltage characteristic and an excellent anti-sputter characteristic endurable on ion sputtering. And, the AC type PDP shown in FIG. 2 is provided with a dielectric layer 10 each covering sustain electrodes 7 and 8 and an address electrode 9 for forming a capacitance coupled discharge. In general, the dielectric layer is formed of a material to selected from borosilicate group coated with a thin film of oxide, such as magnesium oxide, as a protection film 11 because the dielectric layer 10 of borosilicate group has a lower secondary electron emission coefficient and a short lifetime against sputtering of ions in the plasma. The magnesium oxide MgO has a good anti-sputter characteristic, but also a high secondary electron emission coefficient that provides a low voltage characteristic. However, since the magnesium oxide layer should be thin and have an excellent surface characteristic, the magnesium oxide layer is in general formed by a thin film formation process of vacuum deposition, rather than thick film formation in printing. The barrier rib 5 is required to have a height of 100~200 $\mu$m for maintaining discharge distance and volume. As one layer of thick film printing is a few tens of $\mu$m, the barrier rib 5 may be form by multi-layers of the thick film printing. And, though a number of electrodes required for a discharge is two, in general an electrode structure with three electrodes is mostly used. The DC type PDP has an additional supplementary cathode for forming a supplementary discharge, and the AC type PDP is introduced of an address electrode 9 for separating the sustain electrodes 7 and 8 from a selective discharge and sustain discharge to improve an address speed. Accordingly, the electrode structures may be classified as a two electrode structure and a three electrode structure according to a number of electrodes. Or, the electrode structures may be classified as an opposite type electrode structure and a surface discharge type electrode structures. In the opposite type electrode structure, two sustain electrodes for occurring a discharge are disposed on the front substrate and the back substrate respectively to cause a discharge formed vertical to the panel, and, in the surface discharge type electrode structure, the two sustain electrodes for occurring a discharge are disposed on the same substrate, to form a discharge on one plane of the panel.

FIG. 3 illustrates a perspective view of a background art AC type PDP, provided with a front substrate 1 form of glass for easy transmission of a light, sustain electrodes 7 and 8 each composed of a transparent electrode and a metal electrode on a top surface of the front substrate 1 disposed in a transverse direction at fixed intervals for sustaining a discharge voltage, a dielectric layer 10 formed on an entire surface of the front substrate 1 inclusive of the sustain electrodes 7 and 8 for protecting the sustain electrodes 7 and 8, a protection layer for protecting the dielectric layer 10 to prolong a lifetime of the dielectric layer 10, improving a secondary electron emission effect, and reducing variation of a discharge characteristic, a back substrate 2, a lower base film 12 on an entire top surface of the back substrate 2, address electrodes 9 on the lower base film 12 formed in a direction perpendicular to the sustain electrodes 7 and 8 at fixed intervals, a white back 13 formed on an entire surface of the lower base film 12 inclusive of the address electrodes 9, barrier ribs formed between, and in parallel to underlying address electrodes 9 for maintaining a space between the front substrate 1 and the back substrate 2 and preventing unwanted discharge between cells, and R, G, B fluorescent material layers 6 formed between the barrier ribs 6. Upon finish of fabrication of the front substrate 1 and the back substrate 2, an air drawing hole is formed in the back substrate 2 for filling a desired discharge gas at a vacuum once fabrication of the front substrate 1 and the back substrate 2 are completed. Then, bonding frit is applied at rims of the front substrate 1 and the back substrate 2, and the front substrate 1 and the back substrate 2 are bonded together, to form a discharge region between the front substrate 1 and the back substrate 2. A discharge gas of a desired light characteristic is filled through the air drawing hole, and the hole is sealed, to complete a PDP fabrication.

In the meantime, in order to display colors in the PDP, a principle the same with the CRT is employed, in which fluorescent materials are excited. Though an electro-luminescence of an electric field excited by electrons accelerated to a few ten KeV is employed in the case of a CRT, a photo-luminescence, an excitation of fluorescent material by an ultra-violet ray from a gas discharge, is employed in the case of the PDP. Particularly, a 147 nm vacuum UV ray of Xenon gas is mostly used. Accordingly, fluorescent materials are coated on the PDP electrode structure for displaying colors.

Also, there are a transmissive type of PDP electrode structure and a reflective type of PDP electrode structure depending on locations of coating of the fluorescent materials. Though the transmissive type of PDP electrode structure is simple in fabrication, there are a great variation depending on a printed surface condition of the fluorescent material, and, though the reflective type PDP electrode structure can enlarge an area of fluorescent material coating with an increased luminance, coating of the fluorescent material is difficult. The reflective type PDP electrode structure has a higher luminance than the transmissive type PDP electrode structure, and as the difficulty in coating the fluorescent material has also been solved according to the development of thick film printing technology and new development of technology such as sandblasting, the reflective type PDP electrode structure is widely used, currently.

As explained, the gas discharge display applied mostly to the PDP, being a core technology for displaying an image, utilizes the Penning Effect. The Penning Effect is a reaction in which an ionization is enhanced through species having very large collision section, wherein an α-process of Thounsand is increased.

For example, the Penning Effect of He+Xe and Ne+Xe is as follows.

$$He^{*}+Xe \rightarrow Xe^{++}+e+He$$

$$Ne^{*}+Xe \rightarrow Xe^{++}+e+Ne$$

Where He and Ne are major gases, Xe is an additive gas, and He* and Ne* are quasi stable or excited particles of pertinent particles. Because each of these excited particles has relatively long life time with a large collision sectional area, with a greater probability of collision to other particles as much, the ionization is enhanced from the influence of these neutral excitestables when He, and Ne gases are added compared to the case when there is Xe gas only in the aforementioned equation.

Together with this, the secondary electron emission from a surface of material the plasma is in contact with is very important to the discharge characteristic of the PDP. Particularly, the secondary electron emission caused by plasma from the electrode covered with dielectric as in the case of the AC type PDP may come from direct ion impact, surface reaction of metastables, and reaction caused by light and the like, of which major one is the reaction from ion impact. A neon ion with an ionization energy 21.6 eV is incident, to couple with one electron in a valence band and be neutralized, to cause a surplus energy to discharge an electron in another valence band to a surface. In this instance, a motion energy of the electron can be obtained by subtracting a band gap energy and a surface work-function energy of MgO from an incident ion energy. The electron is accelerated in field, and generates an ion and electrons in a plasma state when a collision happens.

Next, VUV in the gas discharge display will be explained. The VUV is UV of a wavelength below 200 mm. The VUV can not pass through a gas, but is heavily absorbed to the gas if a pressure of mother gas is high, or oxygen is contained therein. A wavelength and an intensity of VUV are important factors that determines a luminance of a light emitted from the PDP. An UV ray from Xenon Xe has a wavelength ranging 140 mm~180 mm, which is consistent with a wavelength region in which R, G, B fluorescent materials give the best efficiency. Of inert gases, since helium He and neon Ne emit light of a short wavelength below 100 nm, helium He and neon Ne are not suitable for use as gases which emit an UV ray that excites the fluorescent materials to emit visible light. Taking an intensity and a wavelength of an emit UV ray into account, though xenon Xe appears suitable for use as a PDP gas, a mixture of two or three gases are generally used because a driving voltage or a lifetime of the electrode should be considered for using a gas in the PDP on the same time, typical one of which mixture of two gases is helium He or neon Ne added with xenon Xe, which lowers a driving voltage and improves an UV efficiency. As such, helium He or neon Ne is used as a major gas, because an excitation of xenon is efficient due to a higher temperature of electron in the gas compared to a pure xenon and a Penning effect of xenon can be used. And, even in the case of mixture of gases, conditions giving the maximum UV efficiency may be different depending on a ratio of mix and other discharge conditions.

FIG. 4 illustrates a graph showing UV ray intensity from a DC type cell vs. pressure of He+Ne gas therein, wherefrom it can be known that, as the pressure becomes higher, a DC type cell of which positive column is adapted to be used as a major luminous region is involved in drop of the UV intensity, and DC type cell of which negative glow is used as a major luminous region is involved in rise of the UV intensity, i.e., it can be known that a trend according to a partial pressure of xenon Xe may differ depending on a structure of a discharge cell.

FIG. 5 illustrates a relative wavelength of xenon vs. a pressure of He+Xe(7%), wherefrom it can be known that as a pressure of He+Xe(7%) gas become higher, an intensity of light with a wavelength of 173 nm emitted from $Xe_2$* is increased while an intensity of UV ray with a wavelength of 147 nm emitted from $Xe_2$* is decreased. This is because dimers, molecular particles, can be produced with ease as the pressure become higher. In view of a distance from an electrode, a luminance in a negative glow region near to a cathode surface is the highest, and much light is emitted from a positive column region as a distance from the electrode becomes far. The negative glow and the positive column are compared that, though the luminance in the negative glow is higher, a portion of the positive column is very large if a total amount of light emitted per a unit time period is considered. Especially, while the negative glow region is limited, since the positive column region is increased as the electrodes distanced far, the positive column region may give a dominating influence depending on an electrode structure. $Xe^*(^3P_1)$ is produced in plasma through a path including excitation by an electron, formation of xenon molecule ions by recoupling, transition to a resonance state of particles in a quasi stable state by collision, and so on. And, $Xe_2$*(173) is produced by three of xenon collision of Xe* to neutral particle. Thus, as a composition and a pressure of gas can make a wavelength and an efficiency of light different, and a cell structure or a driving circuit indirectly affects to this, determination of an optimal discharge gas should be made in combination with a cell structure and a driving circuit.

FIG. 6*a* illustrates data on a spectrum of light emitted from neon gas singly sealed in a gas discharge display, FIG. 6*b* illustrates data on a spectrum of light emitted from xenon gas singly sealed in a gas discharge display, and FIG. 6*c* illustrates data on a spectrum of light emitted from argon gas singly sealed in a gas discharge display.

Referring to FIG. 6*a,* all the light emission of neon in a range of 5800~7000Å are caused by transition from 3 p(18–19 eV) to 3 s, as shown in FIG. 6*b,* xenon shows an intense light emission both in infrared ray region and ultra-violet region, while a weak light emission in a visible light region. Also, an ion line can be observed at an excitation level of approx. 11 eV because xenon has a low ionization voltage of 2.12 eV and a high discharge voltage (approx. 250V). And, as shown in FIG. 6*c,* the light emission of argon in the vicinity of 7000 Å is caused by transition from 5 p(approx. 14 eV) to 3 s. FIG. 7 illustrates a spectrum of a mixture of two gases based on neon added with xenon(1%). The Ne+Xe, a Penning gas, shows a discharge voltage lower than neon only. That is, once argon gas is added to an existing discharge cell, ionization and excitation are done efficiently, not only to form a high charged particle density, but also to increase excitation in which a vacuum UV ray is emitted. As a result, emitted vacuum UV ray is increased, that induces excitation of the fluorescent materials with an improvement of luminance and a reduction of a driving voltage for causing the discharge, which improves an efficiency.

FIGS. 8 and 9 illustrate test results on mixture of three gases, addition of argon gas to an existing mixture of two gases. If FIGS. 8 and 9 are reviewed in combination, it can be known that a discharge starting voltage is lowered and a vacuum UV ray emission is increased when argon gas is added thereto at a ratio of approx. 0.001%~1.0% compared to the case when a mixture of two gases is used. FIG. 8 illustrates measurements of discharge starting voltage vs. a composition ratio of argon gas in a mixture of Ne+Xe+Ar, wherein it can be known that the discharge starting voltage is reduced when argon is mixed up to a composition ratio 0.001%~1.0%, particularly at 0.3%~0.7%, with the best efficiency at 0.5% in the mixture of Ne+Xe+Ar. FIG. 9 illustrates an amount of vacuum UV ray vs. a composition ratio of argon gas in the mixture of three gases of Ne+Xe+Ar. As shown, an amount of vacuum UV ray at a composition ratio of 0.001~1.0% of argon in the mixture of Ne+Xe+Ar is greater than the mixture of two gases Ne+Xe, and as shown in FIG. 8, the vacuum UV ray is much more in a composition ratio of 0.3~0.7% of argon, and the most at a composition ratio of 0.5. FIG. 10 illustrates discharge starting voltage and sustain voltage vs. a composition ratio of xenon in a mixture of $He_x$+$Ne_{1-x}$: x=0.7 at a fixed pressure of 500 torr. Though a composition ratio used is within a range of 0.001~10%, as shown in FIG. 10, the voltage reduction is shown at a composition ratio of 0.001~4%, with a peak of the voltage reduction at 0.001~2% and the best at 1%.

However, a mixture of two or three gases in place of a single gas used for dropping the discharge starting voltage has caused a luminance drop, and basically, a display with the mixture of two gases has a luminance lower than display of CRT. And, though xenon gas generates the longest wavelength of inert gases in terms of UV ray, xenon gas can not be used singly due to too high discharge starting voltage, but used together with a mixture of two gases of neon or helium to drop the discharge starting voltage, which however causes a problem of degradation of color purity and lifetime. That is, as shown in FIG. 11, because neon+4% xenon exhibits a degradation of color purity as a color coordinate 'X'-axis shows "0.6" due to orange visible light, and helium+4% xenon has a problem of short lifetime, [He:Ne(7:3)]+4% xenon, or [He: Ne(8:2)]+4% xenon is used for improving the color purity. However, as shown in FIG. 12, as [He:Ne(8:2)]+4% xenon shows a discharge luminance of 6 cd/$m^2$ and the [He:Ne(7:3)]+4% xenon shows a discharge luminance of 12 cd/$m^2$, an effect of a color purity improvement higher than a certain level can not be expected. Thus, though a mixture of three gases of helium, neon and xenon has been used for improving degradation of color purity when a mixture of two gases is used in a background art PDP, the mixture of three gases could not satisfy essential conditions of a plasma display panel of a low discharge starting voltage, a high luminance, improved color purity and a long life on the same time.

SUMMARY OF THE INVENTION

Accordingly, the present invention is directed to a gas discharge display that substantially obviates one or more of the problems due to limitations and disadvantages of the related art.

An object of the present invention is to provide a gas discharge display which can improve a discharge efficiency to the maximum by using a mixture of four gases.

Other object of the present invention is to provide a gas discharge display which can improve a luminance, maximize an amount of vacuum UV ray, and reduce the discharge voltage to the minimum, to obtain the best luminance efficiency.

Another object of the present invention is to provide a gas discharge display which can satisfy requirements for a long lifetime, a low driving voltage, a high luminance, and a high color purity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the gas discharge display includes a Penning gas of a mixture of four gases which is a mixture of three gases of He+Ne+Xe added with argon gas.

In other object of the present invention, there is provided a gas discharge display having a gas discharge region formed by sealing a rim of a first, and second substrates arranged parallel to each other, a gas discharge electrode on an inside surface of at least one of the two substrates, and a fluorescent material layer adapted to be excited by an ultra-violet ray generated from a discharge gas, wherein the discharge gas filled in the gas discharge region is a mixture of three gases of xenon, helium, and neon, added with argon gas at a composition ratio of 0.2~0.7% to a total mass.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. First, for better understanding of the present invention, characteristics of a single gas in discharge gases used in a gas discharge display will be explained briefly, and then a discharge characteristic of mixtures of the gases will be explained.

FIRST EMBODIMENT

Figure 10:
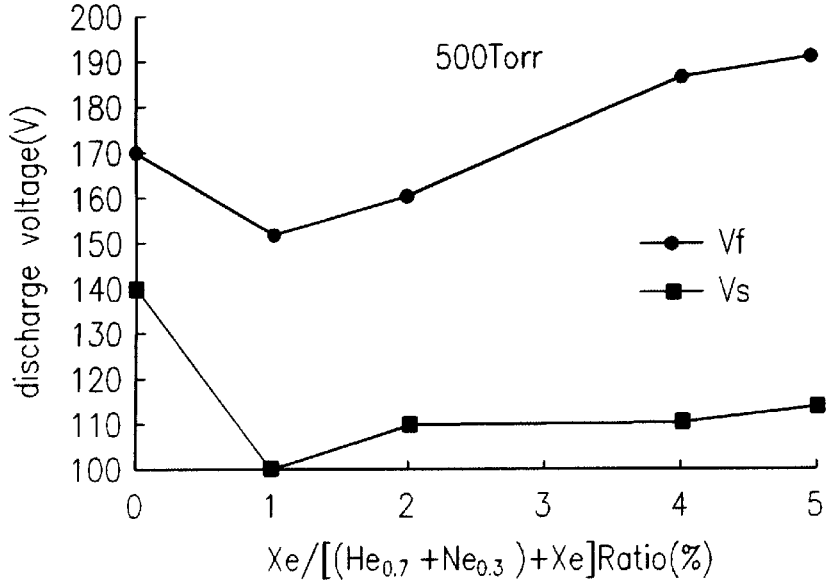
FIG.10 Background Art
FIG. 10 illustrates a graph showing a composition ratio of xenon gas in a mixture of three gases Ne+Xe+Ar vs. a discharge starting voltage.

In general, a gas discharge display of fluorescent material mostly uses a vacuum UV ray emitted at excitation of xenon Xe. However, since implementation of a satisfactory discharge characteristic only with xenon gas is not possible, a mixture of neon and xenon or helium and xenon is used. In most cases, neon gas added with xenon or helium gas added with xenon shows a trend that an emission of vacuum UV ray increases initially as a xenon content increases, and decreases when a composition ratio of the xenon exceeds a certain composition ratio. And, it can be known that an amount of vacuum UV ray emission and a discharge starting voltage of a mixture of three gases He+Xe+Ar or Ne+Xe+Ar differ depending on a composition ratio of argon gas, and it can be known that the discharge starting voltage differs depending on a composition ratio of xenon in the mixture of three gases He+Ne+Ar shown in FIG. 10. In the case of mixture of two or three gases, there are optimal composition ratio of an additive(xenon or argon) to the mixture, and finding an optimal composition ratio is important as a maximum luminance is associated with a maximum efficiency. That is, as shown in FIG. 10, in the present invention, argon gas is added to a mixture of three gases obtained by mixing helium and neon at an optimal composition ratio, and added with xenon at a composition ratio of ranging 0.001~10%, as a fourth gas at a particular composition ratio. The xenon composition ratio is further specifically defined as 0.001~4% range, 0.001~2% range, and 1% range.

Figure 1:
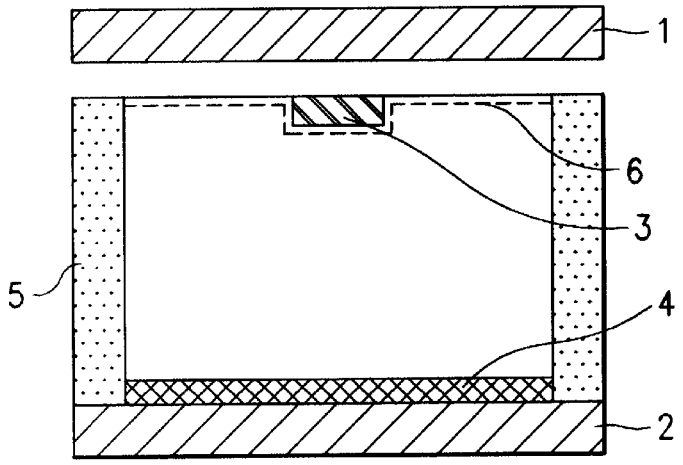
FIG.1 Background Art
FIG. 1 illustrates a section showing an electrode structure of a background art DC type PDP.
Figure 2:
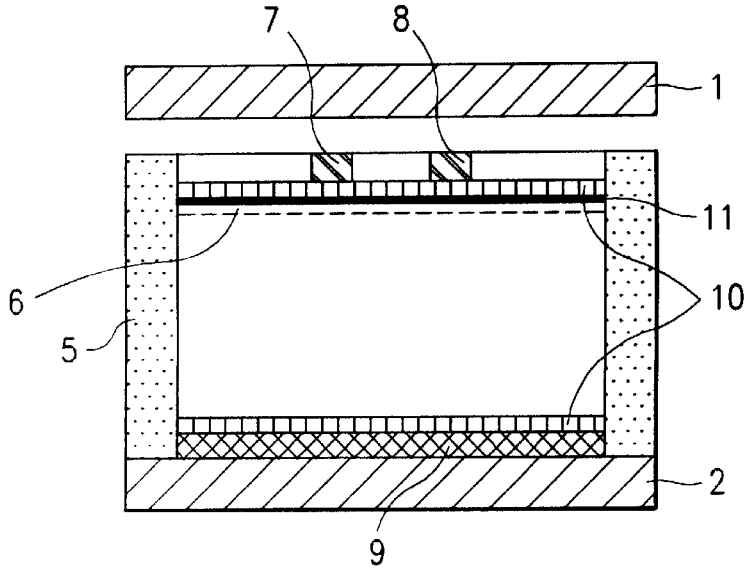
FIG.2 Background Art
FIG. 2 illustrates a section showing an electrode structure of a background art AC type PDP.
Figure 3:
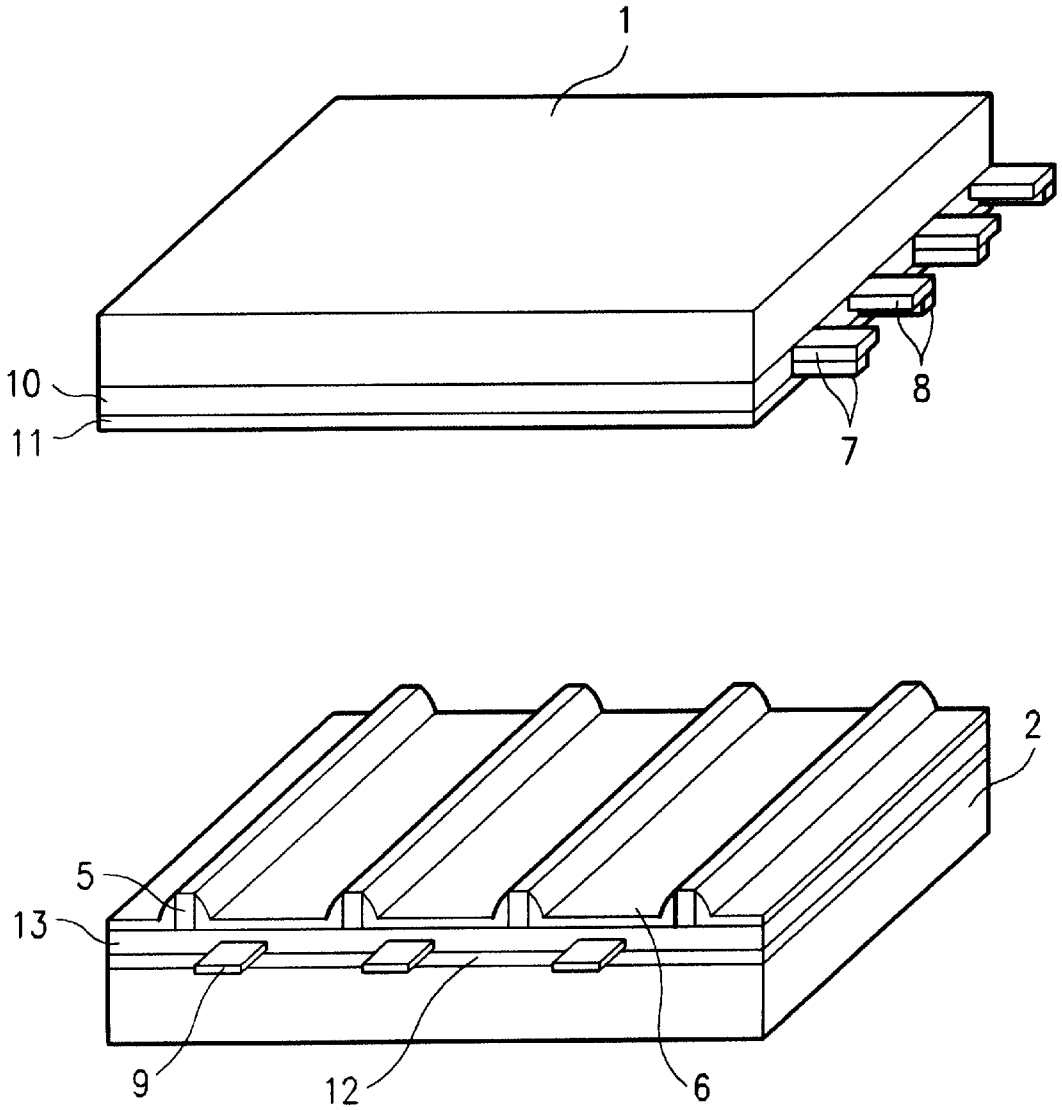
FIG.3 Background Art
FIG. 3 illustrates a perspective view of a background art AC type PDP.
Figure 4:
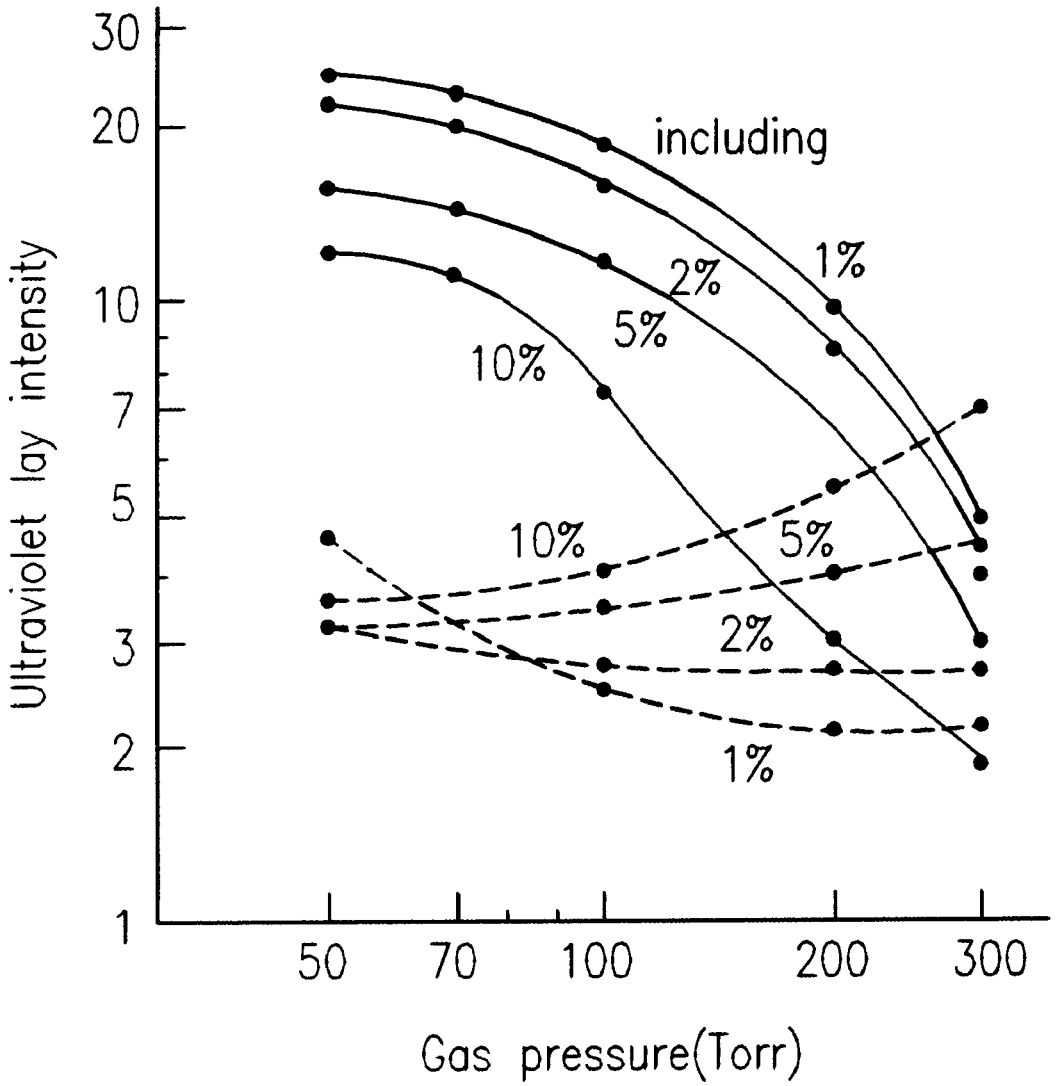
FIG.4 Background Art
FIG. 4 illustrates a graph showing UV ray intensity from a DC type cell vs. pressure of He+Ne gas therein for different composition ratio of xenon.
Figure 5:
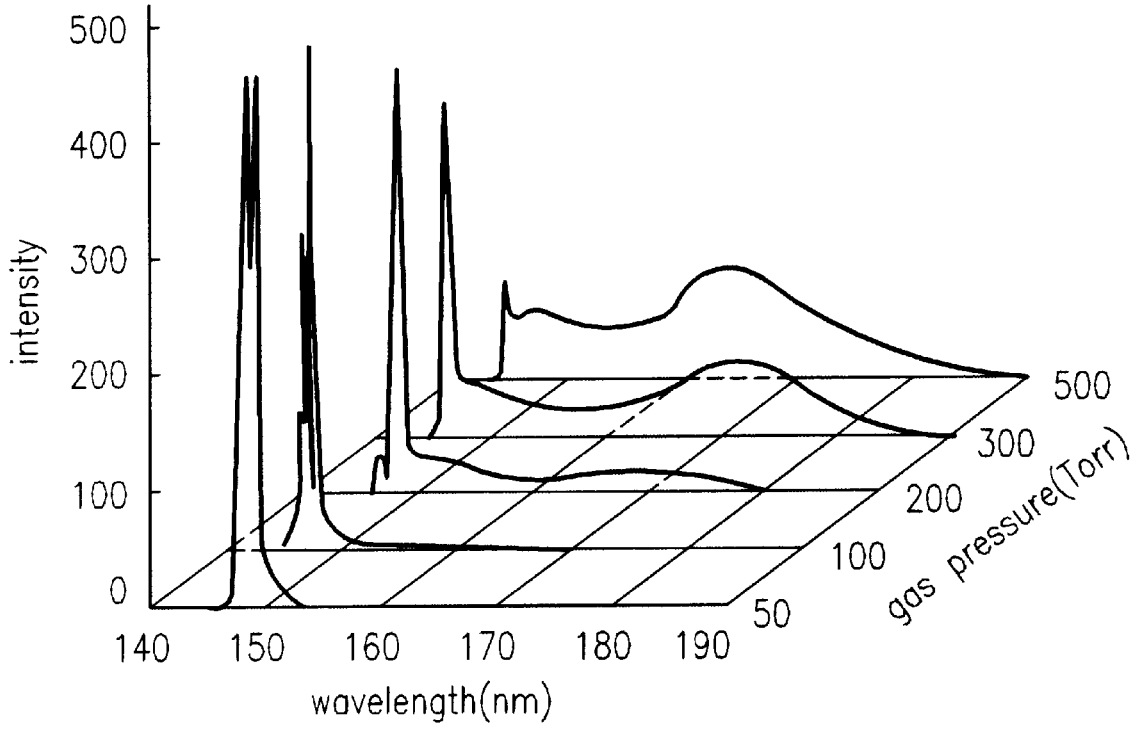
FIG.5 Background Art
FIG. 5 illustrates wavelength of xenon vs. intensify and a pressure of He+Xe(7%)
Figure 6A:
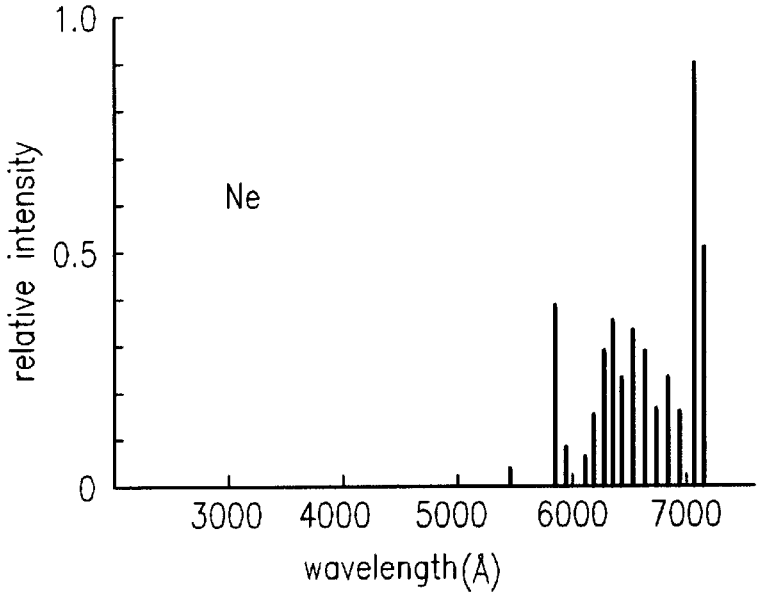
FIG.6A Background Art
FIG. 6*a* illustrates a graph showing wavelength vs. relative intensity of a discharge gas of neon.
Figure 6B:
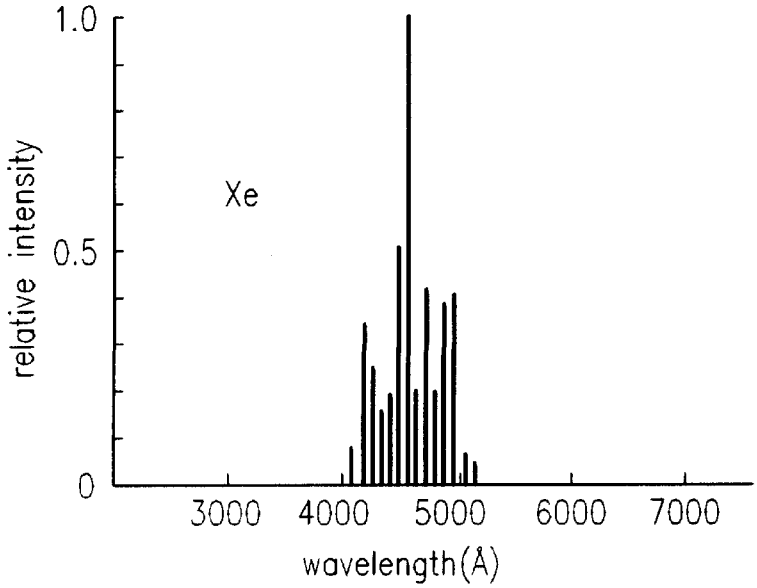
FIG.6B Background Art
FIG. 6*b* illustrates a graph showing wavelength vs. relative intensity of a discharge gas of xenon.
Figure 6C:
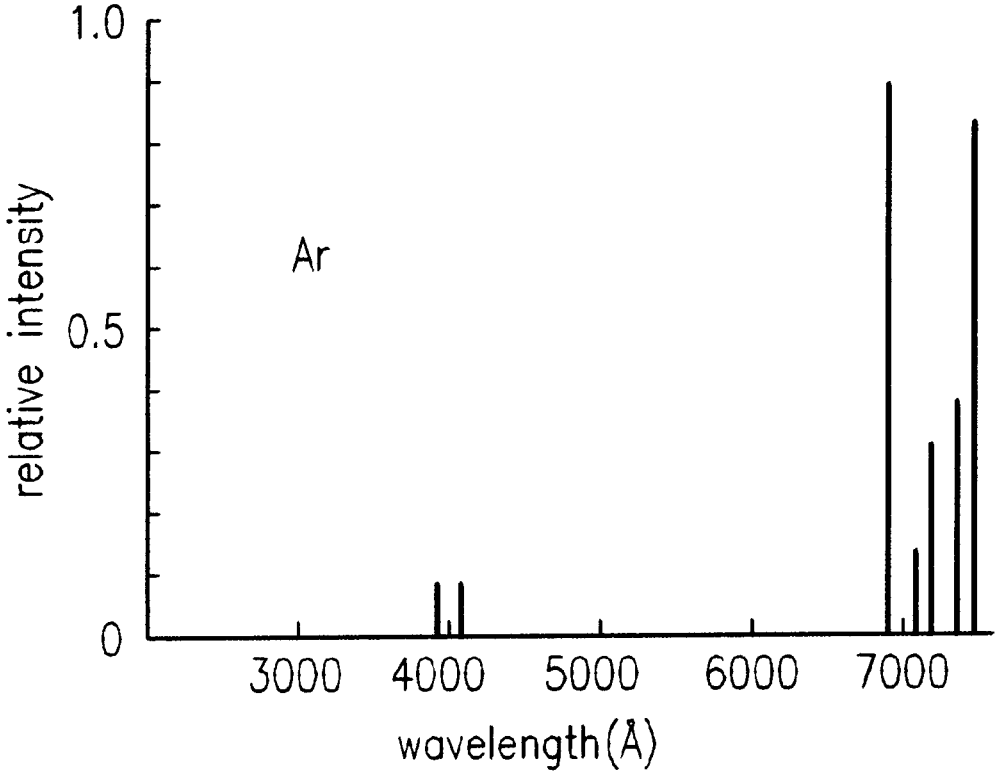
FIG.6C Background Art
FIG. 6*c* illustrates a graph showing wavelength vs. relative intensity of a discharge gas of argon.
Figure 7:
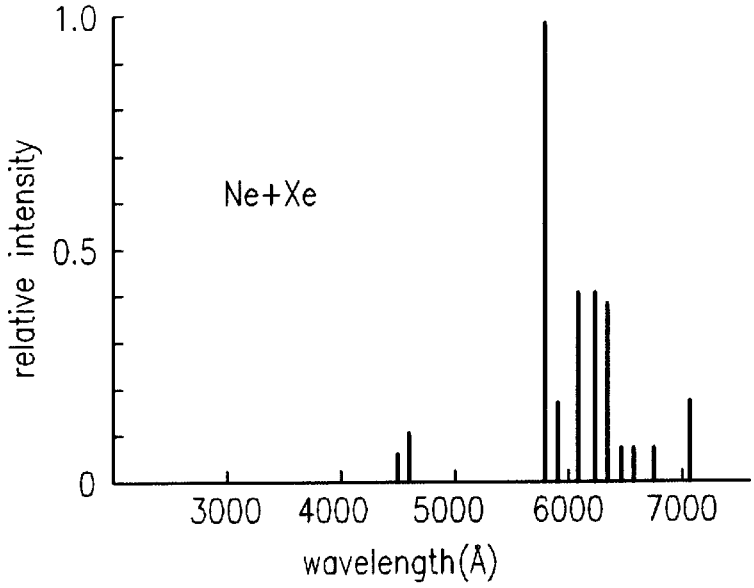
FIG.7 Background Art
FIG. 7 illustrates a graph showing wavelength vs. relative intensity of a Penning gas of two gases Ne+Xe.
Figure 8:
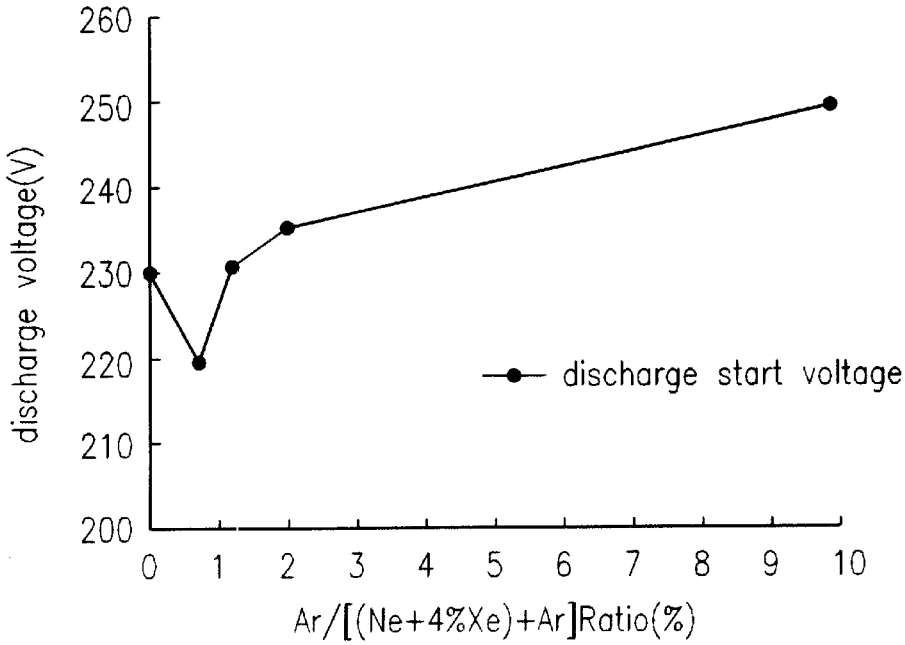
FIG.8 Background Art
FIG. 8 illustrates a graph showing a composition ratio of argon gas in a mixture of three gases Ne+Xe+Ar vs. a discharge starting voltage.
Figure 9:
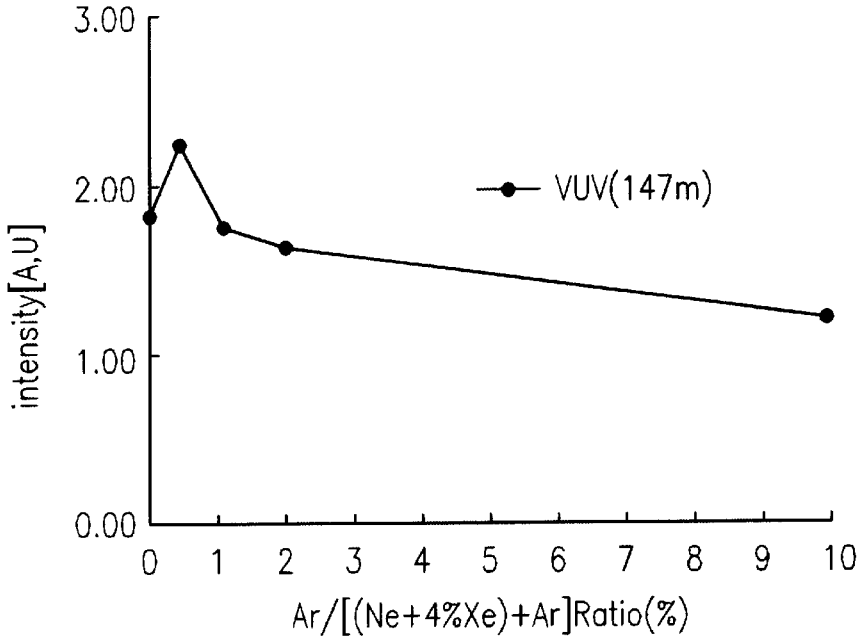
FIG.9 Background Art
FIG. 9 illustrates a graph showing a composition ratio of argon gas in a mixture of three gases Ne+Xe+Ar vs. a vacuum UV ray.
Figure 13:
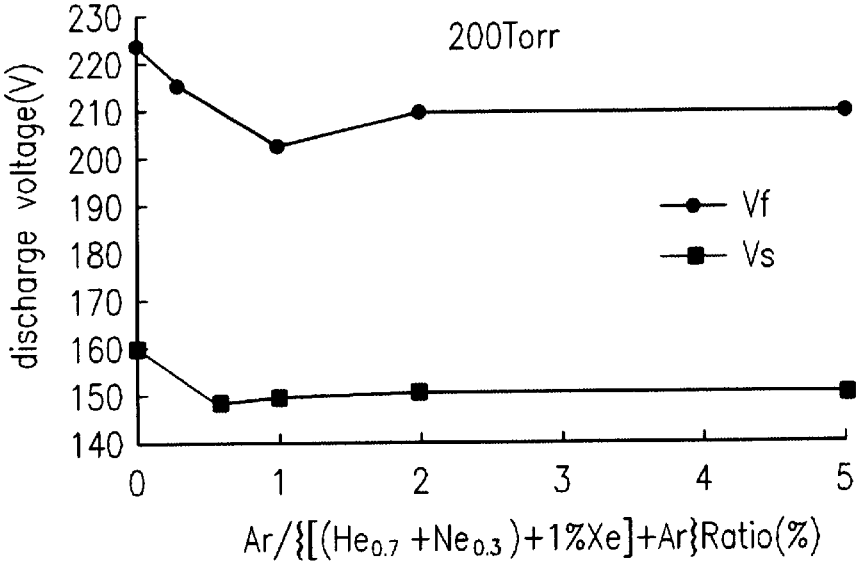
FIG. 13 illustrates a graph showing a gas composition ratio of argon in a mixture of four gases vs. discharge starting voltage at a gas pressure of 200 torr in accordance with a preferred embodiment of the present invention.
Figure 14:
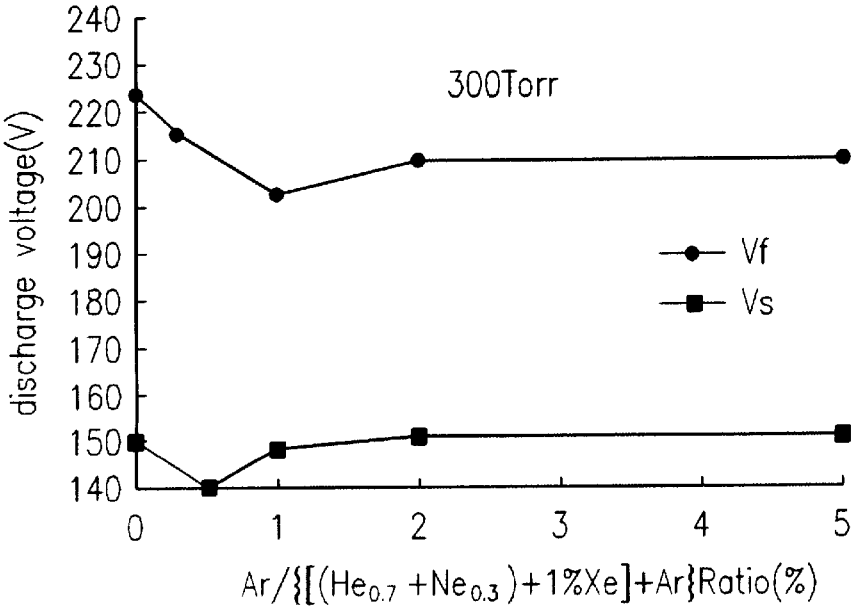
FIG. 14 illustrates a graph showing a gas composition ratio of argon in a mixture of four gases vs. discharge starting voltage at a gas pressure of 300 torr in accordance with a preferred embodiment of the present invention.

FIGS. 13 and 14 illustrate test results of a mixture gas of a first preferred embodiment of the present invention, in which helium and neon are mixed to an optimal ratio to give an optimal efficiency as shown in FIG. 9, the mixture of helium and neon gases is mixed with xenon at a composition ratio of 0.001~4% to obtain a mixture of three gases, and argon gas is mixed to the mixture of three gas, wherein FIG. 13 illustrates a composition ratio of argon gas in a mixture of four gases vs. discharge starting voltage and sustain voltage at a pressure of 200 torr, and FIG. 14 illustrates a composition ratio of argon gas in a mixture of four gases vs. discharge starting voltage and sustain voltage at a pressure of 300 torr. As shown in FIGS. 13 and 14, according to the test results of the present invention, the discharge starting voltage Vf is intense up to 0.001~5% of a composition ratio of argon gas in a mixture of four gases, reaches peak at 0.5~2% of a composition ratio of argon gas in a mixture of four gases, and shows the best efficiency at 1% of a composition ratio of argon gas in a mixture of four gases. The Vs in FIGS. 13 and 14 are a sustain voltage.

SECOND EMBODIMENT

Figure 16:
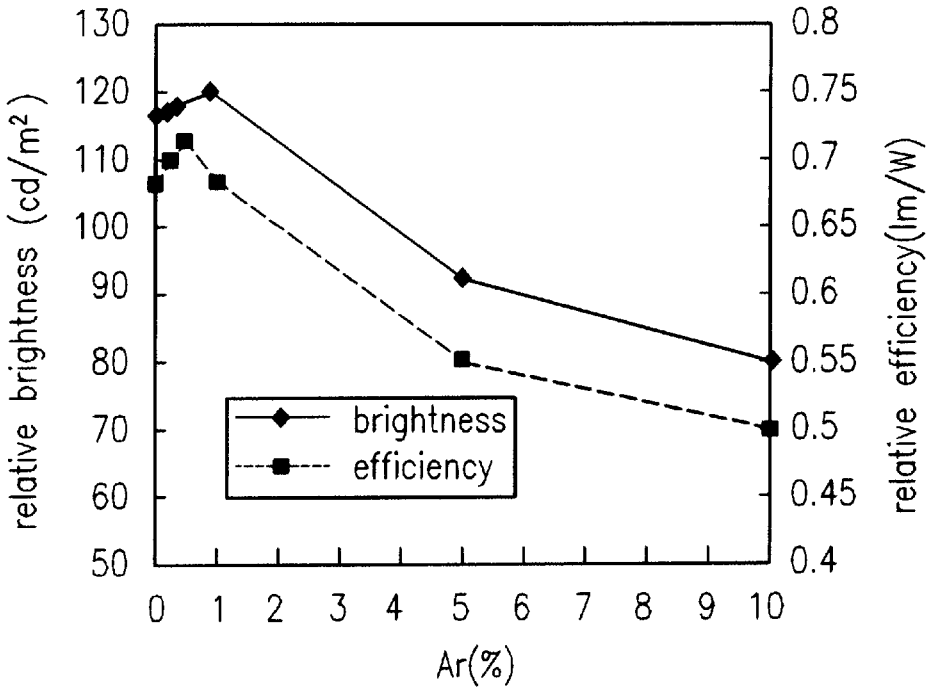
FIG. 16 illustrates a graph showing a gas composition ratio of argon in a mixture gas vs. discharge luminance and efficiency at 400 torr in accordance with a preferred embodiment of the present invention; and, FIG. 17 illustrates a graph showing a gas composition ratio of argon in a mixture gas vs. discharge starting voltage in accordance with a preferred embodiment of the present invention.
Figure 17:
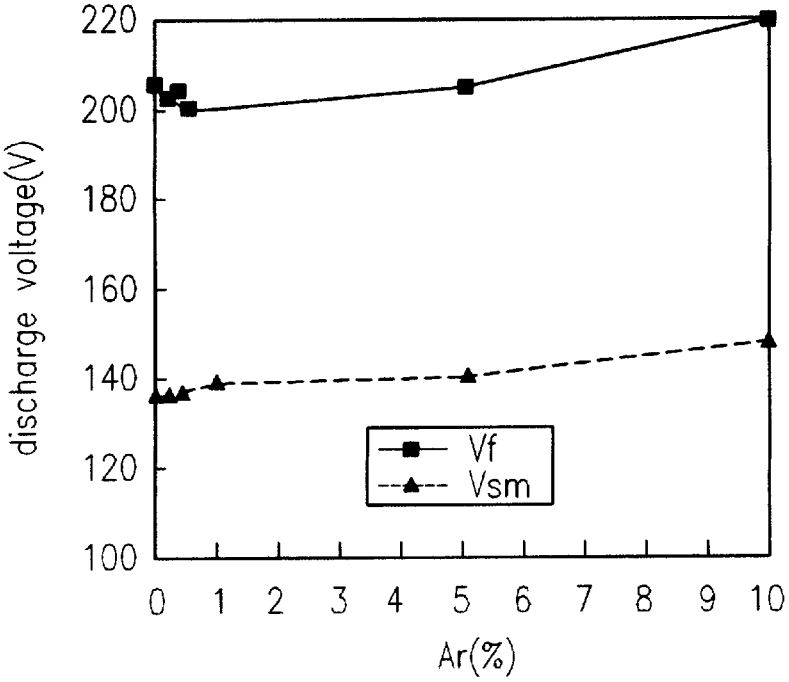

The gas discharge display of the present invention is filled with a discharge gas, a mixture of three gases added with argon gas of 0.2~0.7% of total weight, through an air drawing hole in a back substrate 6, whereby satisfying requirements for a long lifetime, a low driving voltage, a luminance, and a color purity on the same time, of which actual test results will be explained with reference to FIGS. 15~17.

Figure 11:
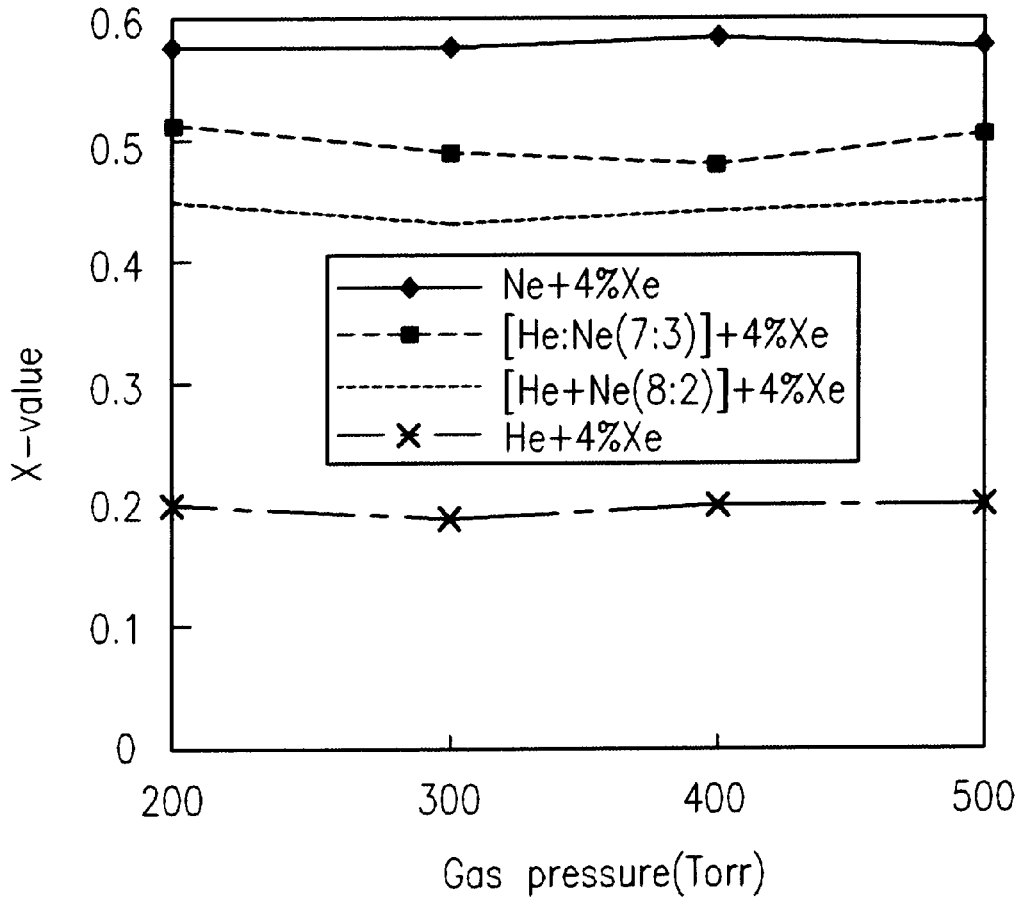
FIG.11 Background Art
FIG. 11 illustrates a graph showing color coordinate vs. gas pressure of different background art discharge gas.
Figure 12:
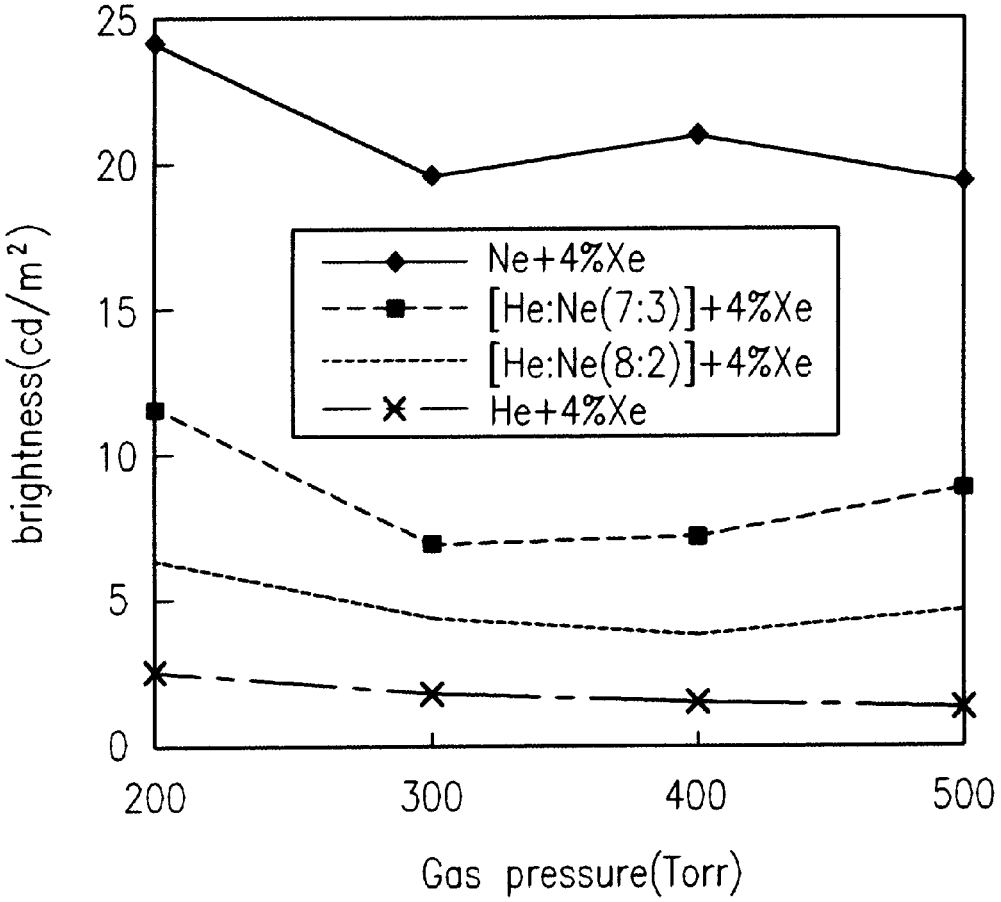
FIG.12 Background Art
FIG. 12 illustrates a graph showing discharge luminance vs. gas pressure of different background art discharge gas.
Figure 15:
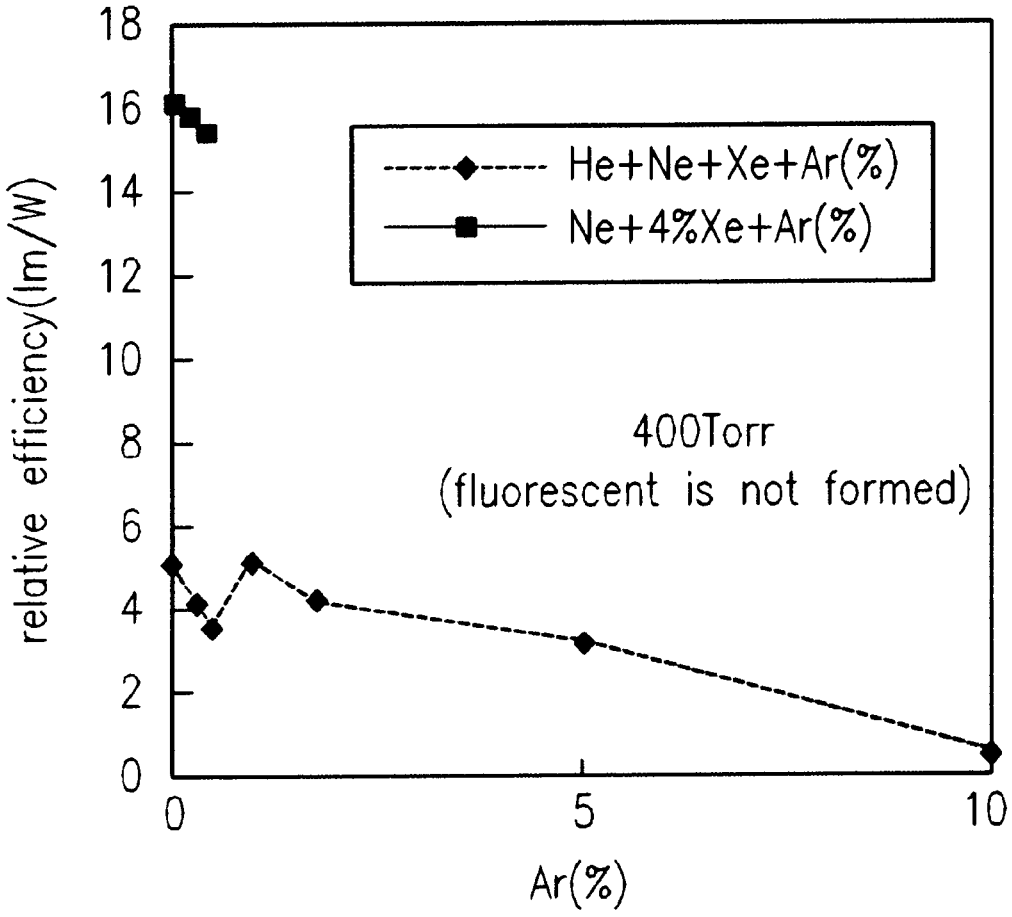
FIG. 15 illustrates a graph showing a gas composition ratio of argon in a mixture gas vs. discharge luminance in accordance with a preferred embodiment of the present invention.

Referring to FIG. 15, it can be known that a discharge luminance differs if a plasma display panel coated with no fluorescent material layer 11 and filled with a discharge gas, a mixture of three gases of helium, neon, and xenon added with argon, is driven; if argon gas is added at a ratio of 0.2~0.7% of a total weight of the discharge gas, the discharge luminance is reduced by approx. 37% to approx. 3 cd/m$^2$ compared to a case when the mixture of three gases without addition of argon is used, when the ratio is increased, the discharge luminance is reduced after temporary increase to show a discharge luminance almost identical to the case when the ratio is 0.2~0.7% when the ratio is approx. 5%, and, when the ratio of argon is greater than 10%, the discharge luminance comes closer to 0 cd/m$^2$. When the composition ratio of argon is 0.2~0.7%, it can be known that the discharge luminance is dropped by approx. 3 cd/m$^2$ from 6 cd/m$^2$ to 3.2 cd/m$^2$ if the discharge luminance is compared to the case of mixture of three gases [He:Ne(8:2)]+4% xenon when the color purity is much improved, i.e., the discharge luminance is low explained in association with FIG. 11. And, as shown in FIG. 16, it can be known that luminance and efficiency are the highest at 120 cd/m$^2$ and 110 lm/W respectively when the composition ratio of argon is 0.2~0.7% at a pressure of 400 torr, and if the ratio is increased, a rate of the ratio increase and the luminance and the efficiency are almost reversely proportional. The efficiency is defined as a rate of luminance for a power consumption per unit area. And, as shown in FIG. 17, when argon is added to a mixture of three gases at a composition ratio of 0.2~ 0.7%, entire cell turn-on completion voltage Vf, i.e., a voltage when turn-on of entire cells are completed for the first time under a state the entire cells in the panel are applied of signal for operation of the cells, is the lowest at 200V, with a lowest turn-on sustain voltage Vsm of 130V, and if the ratio of argon is increased, the entire cell turn-on completion voltage Vf and the minimum turn-on sustain voltage Vsm rise. In conclusion, it can be known that, though an effect of improvement of the color purity is improved as the composition ratio of argon is increased, even in the case of the composition ratio of argon is 0.2~0.7%, an effect of significant color purity improvement compared to the background art can be obtained, and the highest luminance and efficiency, the lowest driving voltage, i.e., the lowest entire cell turn-on completion voltage Vf, and the lowest turn-on sustain voltage Vsm can be also obtained at the 0.2~0.7% composition ratio of argon. Therefore, it is clearly verified that an optimal composition ratio of argon gas that satisfying all operation requirements is 0.2~0.7%.

As has been explained in detail, the gas discharge display of the present invention has the following advantages.

First, the simplified driving circuit permitted by the lowered discharge starting voltage in the present invention allows a reduction in a production cost of a gas discharge display.

Second, the Penning gas for the gas discharge display of the present invention, prepared by mixing xenon at a particular ratio in a mixture of two gases He+Ne to obtain an optimal efficiency and adding argon gas thereto at a particular ratio as a fourth gas, improves a luminance of a gas discharge display.

Third, the addition of argon gas at a ratio of 0.2~0.7% in the mixture of three gases in the present invention, solving the problems of the background art mixture of three gases, allows to satisfy the requirements for a gas discharge display, i.e., a long lifetime, a low driving voltage, a high luminance, and a high color purity on the same time, thereby maximizing a reliability of the product.

It will be apparent to those skilled in the art that various modifications and variations can be made in the gas discharge display of the present invention without departing from the spirit or scope of the invention. Thus, it is intended that the present invention cover the modifications and variations of this invention provided they come within the scope of the appended claims and their equivalents.

What is claimed is:

1. A gas discharge display comprising cathodes and anodes arranged either in parallel or oppositely on two sheets of transparent substrates, barrier ribs for preventing crosstalk between pixels, and a discharge gas sealed in spaces formed by the substrates and the barrier ribs for generating ultra-violet ray, wherein the discharge gas includes a gas mixture of neon, xenon, helium, and argon in the following proportions:

a mixture of helium, neon, and xenon in an amount totaling from 95% to 99.999% of the total gas mixture wherein the xenon forms 0.001–10% of the helium, neon, xenon mixture;

argon in an amount totaling from 0.001% to 5% of the total gas mixture.

2. A gas discharge display as claimed in claim 1, wherein the mixture of four gases is prepared by mixing helium and neon at an optimal ratio, adding xenon at a composition ratio of 0.001~10% thereto to form a mixture of three gases, and mixing argon gas to the mixture of three gases.

3. A gas discharge display as claimed in claim 1, wherein the mixture of four gases is prepared by mixing helium and neon at an optimal ratio, adding xenon at a composition ratio of 0.001~4% thereto to form a mixture of three gases, and mixing argon gas to the mixture of three gases.

4. A gas discharge display as claimed in claim 1, wherein the mixture of four gases is prepared by mixing helium and neon at an optimal ratio, adding xenon at a composition ratio of 0.001~2% thereto to form a mixture of three gases, and mixing argon gas to the mixture of three gases.

5. A gas discharge display as claimed in claim 1, wherein the mixture of four gases is prepared by mixing helium and neon at an optimal ratio, adding xenon at a composition ratio of 1% thereto to form a mixture of three gases, and mixing argon gas to the mixture of three gases.

6. A gas discharge display as claimed in claim 1, wherein a composition ratio of the argon is 0.001%~5%.

7. A gas discharge display as claimed in claim 1, wherein a composition ratio of the argon is 0.5%~2%.

8. A gas discharge display as claimed in claim 1, wherein a composition ratio of the argon is 1%.

9. A gas discharge display as claimed in claim 1, wherein a composition ratio of the helium, neon, xenon is 6:4–8:2 for helium and neon, with xenon having 4% of total mass.

10. A gas discharge display as claimed in claim 1, wherein a composition ratio of the helium, neon, xenon is 7:3 for helium and neon, with xenon having 4% of total mass.

11. A gas discharge display as claimed in claim 1, wherein a composition ratio of the helium, neon, xenon is 8:2 for helium and neon, with xenon having 4% of total mass.

12. A gas discharge display as claimed in claim 9, wherein a composition ratio of the xenon may vary up to 10% of total mass.

* * * * *